US008733755B2

(12) United States Patent
Taniguchi

(10) Patent No.: US 8,733,755 B2
(45) Date of Patent: May 27, 2014

(54) SHEET SEPARATION TRANSPORT MECHANISM, AND SHEET TRANSPORT DEVICE AND IMAGE FORMING APPARATUS INCLUDING SAME

(71) Applicant: Kyocera Document Solutions Inc., Osaka (JP)

(72) Inventor: Susumu Taniguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/749,074

(22) Filed: Jan. 24, 2013

(65) Prior Publication Data

US 2013/0228963 A1 Sep. 5, 2013

(30) Foreign Application Priority Data

Mar. 1, 2012 (JP) ..... 2012-045215

(51) Int. Cl.
*B65H 3/52* (2006.01)

(52) U.S. Cl.
CPC ..... *B65H 3/5223* (2013.01); *B65H 2404/5311* (2013.01); *B65H 2404/5214* (2013.01); *B65H 2404/611* (2013.01)
USPC ..... 271/121

(58) Field of Classification Search
CPC ..... B65H 3/5223
USPC ..... 271/121, 167
See application file for complete search history.

(56) References Cited

U.S. PATENT DOCUMENTS

| | | | | |
|---|---|---|---|---|
| 5,277,417 | A * | 1/1994 | Moritake et al. | 271/121 |
| 6,354,586 | B1 | 3/2002 | Samoto | |
| 2003/0160381 | A1* | 8/2003 | Sonoda et al. | 271/121 |
| 2004/0051230 | A1* | 3/2004 | Tanaka et al. | 271/121 |
| 2008/0309001 | A1* | 12/2008 | Muramatsu | 271/109 |
| 2009/0026693 | A1* | 1/2009 | Lim | 271/121 |

FOREIGN PATENT DOCUMENTS

| | | | |
|---|---|---|---|
| JP | 63-112342 | A | 5/1988 |
| JP | 08225170 | A * | 9/1996 |
| JP | 10-059554 | A | 3/1998 |
| JP | 2000-198561 | A | 7/2000 |

(Continued)

OTHER PUBLICATIONS

English Abstract for JP 63-112342 A, published May 17, 1988.
English Abstract and Translation for JP 2001-63851 A, published Mar. 13, 2001.

(Continued)

*Primary Examiner* — Gerald McClain
(74) *Attorney, Agent, or Firm* — NDQ & M Watchstone LLP

(57) ABSTRACT

A sheet separation transport mechanism according to the present disclosure includes a sheet feed member, a separation member, a support member, a sheet member and a concave portion. The sheet feed member feeds a sheet in a transport direction. The separation member is pressed onto the sheet feed member. The support member includes: a separation member retaining portion; and a guide portion which guides lead edges of a plurality of sheets to the downstream side along the inclined surface. The sheet member is adhered from the guide portion so as to overlap the separation member and has a frictional coefficient lower than the separation member. The concave portion is formed in the shape of a groove in a position of the guide portion where the sheet member is adhered such that the depth of the concave portion is greater than the thickness of the sheet member.

10 Claims, 6 Drawing Sheets

(56) References Cited

FOREIGN PATENT DOCUMENTS

| | | | | |
|---|---|---|---|---|
| JP | 2001-63851 | A | | 3/2001 |
| JP | 2001-72255 | A | | 3/2001 |
| JP | 2001080772 | A | * | 3/2001 |
| JP | 2001080773 | A | * | 3/2001 |

OTHER PUBLICATIONS

English Abstract for JP 2001-72255 A, published Mar. 21, 2001.
English Abstract and Translation for JP 10-059554 A, published Mar. 3, 1998.
English Abstract and Translation for JP 2000-198561 A, published Jul. 18, 2000.

* cited by examiner

SHEET SEPARATION TRANSPORT MECHANISM, AND SHEET TRANSPORT DEVICE AND IMAGE FORMING APPARATUS INCLUDING SAME

This application is based on and claims the benefit of priority from Japanese Patent Application No. 2012-45215 filed on Mar. 1, 2012, the contents of which are hereby incorporated by reference.

BACKGROUND

The present disclosure relates to a sheet transport device that is used in an image forming apparatus such as a digital copying machine or a laser printer and that transports a sheet or an original document. More particularly, the present disclosure relates to a sheet separation transport mechanism that separates and transports a stack of sheets one by one.

Conventionally, in a paper feed device that is incorporated in a copying machine or the like using an electrophotographic process, transportation is generally performed with the uppermost surface of a stack of sheets pressed onto a paper feed roller. Then, a sheet separation transport mechanism that uses a separation pad pressed onto the paper feed roller to separate and transport only a sheet on the uppermost surface of the stack of sheets.

For example, a paper feed device is known in which, in sheet guide shoots placed on both sides of a division member that divides and then separates and feeds a stack of sheets one by one, shoot ribs higher than the upper surface of the division member are formed, the back surface of a sheet transported between a paper feed roller and the division member is slidingly brought into contact with the shoot ribs to produce a resistance force in the paper feed direction of the sheet and thus the simultaneous feeding of a plurality of sheets is reduced.

A paper feed device is also known in which, in the paper feed device separating and feeding, one by one, sheet members between a paper feed roller and a division member, an inclination angle of the surface of a stack member where the sheet members are stacked with respect to the surface of the division member in contact with the sheet members is made changeable and thus it is possible to adjust, according to the rigidity of the sheet member, the entry angle of the sheet member from the stack member into the division member.

The sheet separation transport mechanism described above is required to have the function of dividing a plurality of sheets one by one and the function of transporting the sheet to the subsequent transport roller. When a higher priority is given to the division function, the frictional force of the separation pad is increased and the transport load is increased, and thus the division function is enhanced; however, especially in heavy paper, the transport load is excessively increased, with the result that the sheet is disadvantageously prevented from being transported to a nip portion (main separation portion) between the paper feed roller and the separation pad.

On the other hand, in order for the function of transporting the heavy paper to be enhanced, the transport load of the division member is lowered such as by decreasing the angle of the separation pad, selecting a separation pad having a low frictional coefficient or reducing a spring load pressing the separation pad; in this case, the division function is degraded.

In particular, when, in an operation of feeding paper from a paper feed cassette and an operation of feeding paper from a manual tray placed above the paper feed cassette, separation transport is performed using the same paper feed roller and separation pad, since the entry angle of the sheet from the manual tray into the separation pad is increased, it is more likely that a sheet, such as heavy paper, that has a high elasticity is disadvantageously stopped in front of a main separation portion.

SUMMARY

An object of the present disclosure is to provide a sheet separation transport mechanism that enhances the function of separating sheets with a simple configuration and thereby can reduce the simultaneous feeding of a plurality of sheets and the failure in the feeding of heavy paper or the like, and a sheet transport device and an image forming apparatus including such a sheet separation transport mechanism.

A sheet separation transport mechanism according to one aspect of the present disclosure includes a sheet feed member, a separation member, a support member, a sheet member and a concave portion. Only an uppermost one of stacked sheets is separated and transported in a nip portion between the sheet feed member and the separation member. The sheet feed member feeds a sheet in a transport direction. The separation member is pressed onto the sheet feed member. The support member includes: a separation member retaining portion which retains the separation member; and a guide portion which is formed in the shape of an inclined surface protruding beyond a surface of the separation member on an upstream side of the separation member retaining portion in the sheet transport direction and which guides lead edges of a plurality of sheets to the downstream side along the inclined surface. The sheet member is adhered from the guide portion so as to overlap the separation member and has a frictional coefficient lower than the separation member. The concave portion is formed in the shape of a groove in a position of the guide portion where the sheet member is adhered such that the depth of the concave portion is greater than the thickness of the sheet member.

Yet other objects of the present disclosure and specific advantages obtained by the present disclosure will be further obvious from the description of embodiments discussed below.

DETAILED DESCRIPTION

Figure 1:
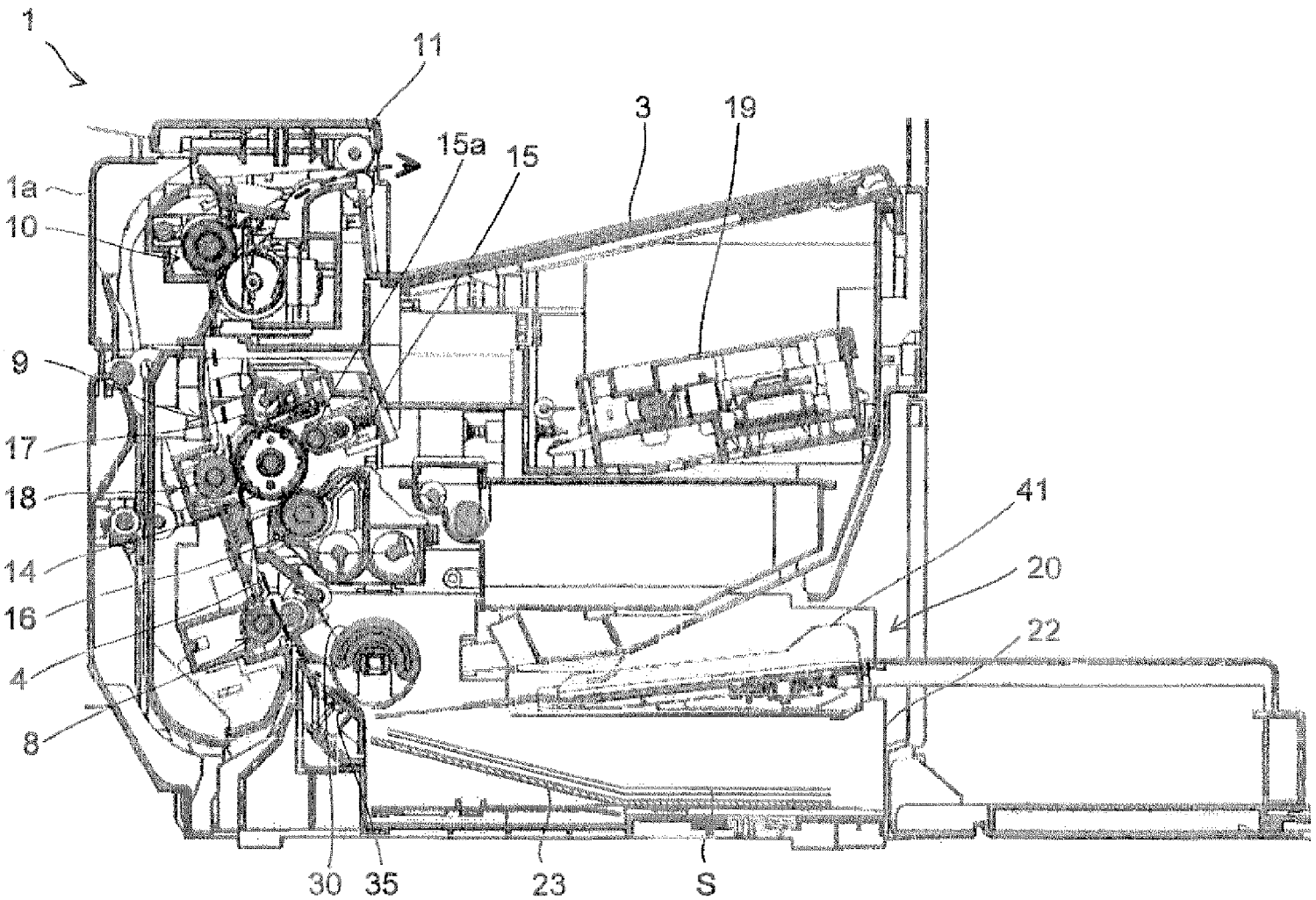
FIG. 1 is a side cross-sectional view showing the overall configuration of an image forming apparatus 1 incorporating a sheet separation transport mechanism 40 of the present disclosure.

An embodiment of the present disclosure will be described below with reference to accompanying drawings. FIG. 1 is a cross-sectional view showing the overall configuration of an image forming apparatus 1 incorporating a sheet separation transport mechanism 40 of the present disclosure, and shows the image forming apparatus 1 with its right side illustrated as the front side of the image forming apparatus 1. In a lower portion of the device body 1*a* of the image forming apparatus 1, a paper feed device 20 is arranged. The paper feed device 20 includes a paper feed cassette 22 holding stacked sheets S and a manual tray (stack tray) 41 arranged above the paper feed cassette 22. In order to hold the sheets S, the paper feed cassette 22 is provided so that the paper feed cassette 22 can be removed from the front of the device body 1*a*. The paper feed cassette 22 may be fixed to the device body 1*a*. Behind the paper feed device 20, a sheet transport path 4 is formed that extends from the bottom of the device body 1*a* toward the top thereof to reach a paper ejection portion 3 formed in the upper surface of the device body 1*a*. A paper feed roller 30, a resist roller pair 8, an image forming portion 9, a fixing portion 10 and an ejection roller pair 11 are arranged, along the sheet transport path 4, in this order from the upstream side.

In the paper feed cassette 22, a sheet stack plate 23 is provided that is supported rotatably with respect to the paper feed cassette 22. When a plurality of sheets S among the sheets S stacked on the sheet stack plate 23 are fed simultaneously toward the sheet transport path 4, the sheets S are divided by the paper feed roller 30 and a separation pad 35 forming the sheet separation transport mechanism 40 (see FIG. 3), and only the uppermost one is fed. The sheet S fed to the sheet transport path 4 is transported to the resist roller pair 8, and is supplied to the image forming portion 9 after timing is adjusted by the resist roller pair 8.

The manual tray 41 feeds, to the image forming portion 9 through the resist roller pair 8, sheets S such as a sheet having sizes other than the sheets stacked in the paper feed cassette 22, an envelope and heavy paper; the sheets S are placed on the manual tray 41 from the front of the device body 1*a*.

The image forming portion 9 uses an electrophotographic process to form a predetermined toner image on the sheet S. The image forming portion 9 is configured to include: a photosensitive drum 14 that is an image carrying member which is pivoted rotatably in a clockwise direction of FIG. 1; a charging device 15, a development device 16 and a cleaning device 17 that are arranged around the photosensitive drum 14; a transfer roller 18 that is arranged opposite the photosensitive drum 14 through the sheet transport path 4; and an exposure device 19 that is arranged to the front of the photosensitive drum 14.

In the charging device 15, a conductive rubber roller 15*a* to which an unillustrated power supply is connected is provided, and the conductive rubber roller 15*a* is arranged to be in contact with the photosensitive drum 14. When the photosensitive drum 14 is rotated, the conductive rubber roller 15*a* is brought into contact with the surface of the photosensitive drum 14 such that they are rotated together. Here, a predetermined voltage is applied to the conductive rubber roller 15*a*, and thus the surface of the photosensitive drum 14 is uniformly charged.

Then, a light beam is emitted from the exposure device 19 to form an electrostatic latent image based on input image data on the photosensitive drum 14. Then, the development device 16 adheres a toner to the electrostatic latent image to form a toner image on the surface of the photosensitive drum 14. Thereafter, the sheet S is supplied, from the resist roller pair 8, between the photosensitive drum 14 and the transfer roller 18 (to a transfer position) at a predetermined timing, and the transfer roller 18 transfers the toner image on the surface of the photosensitive drum 14 onto the sheet S.

The sheet S to which the toner image has been transferred is separated from the photosensitive drum 14 and is transported to the fixing portion 10. The fixing portion 10 is arranged on the downstream side of the image forming portion 9 in the sheet transport direction. The sheet S to which the toner image has been transferred in the image forming portion 9 is heated and pressurized by a heating roller and a pressure roller provided in the fixing portion 10, and thus the toner image transferred to the sheet S is fixed.

The sheet S having the image formed is ejected by the ejection roller pair 11 into the paper ejection portion 3. On the other hand, the toner left on the surface of the photosensitive drum 14 after the transfer is removed by the cleaning device 17, the photosensitive drum 14 is charged again by the charging device 15 and thereafter an image is formed in the same manner as described above.

Figure 2:
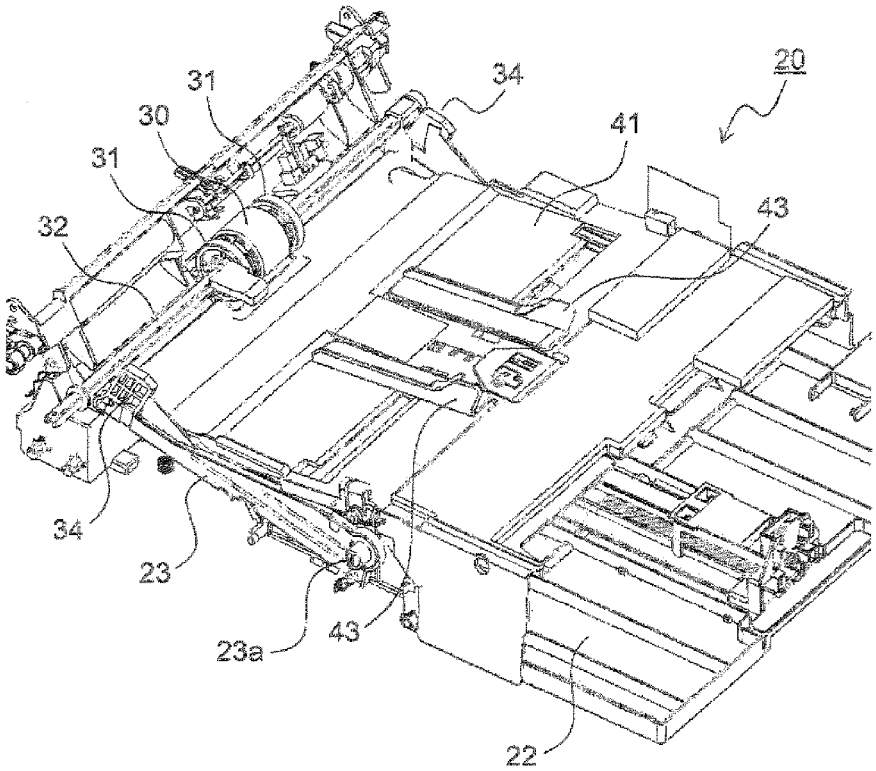
FIG. 2 is a perspective view when a paper feed device 20 of the present disclosure is seen from above.
Figure 3:
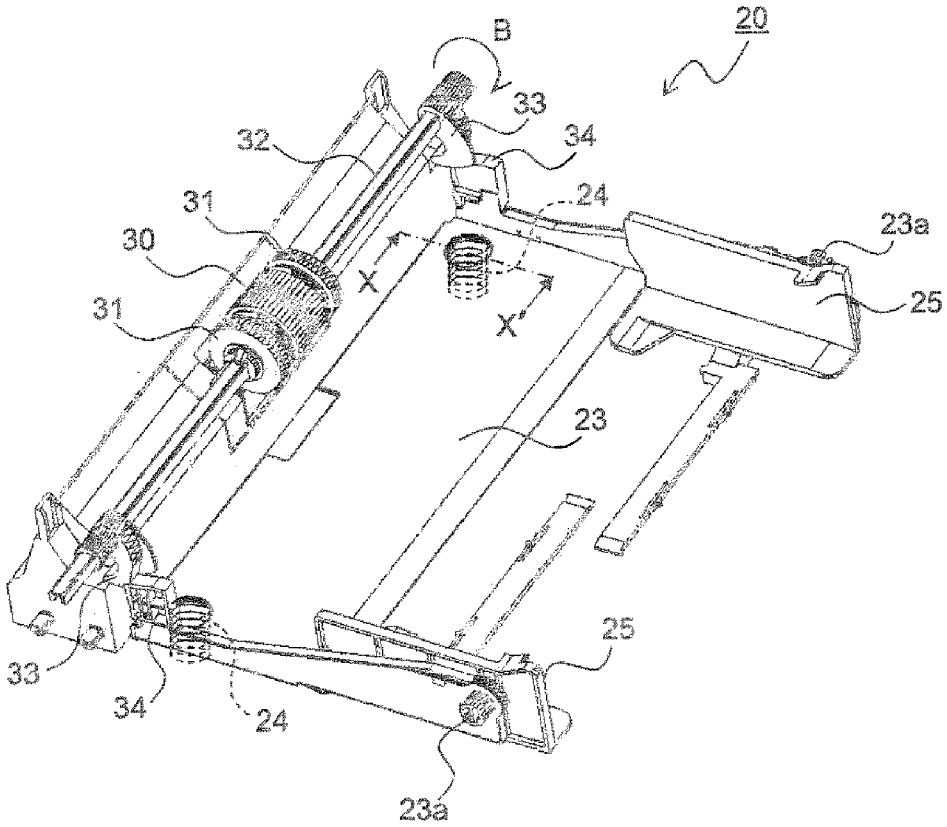
FIG. 3 is a perspective view showing a state where a manual tray 41 is removed from the paper feed device 20 of FIG. 2.
Figure 4:
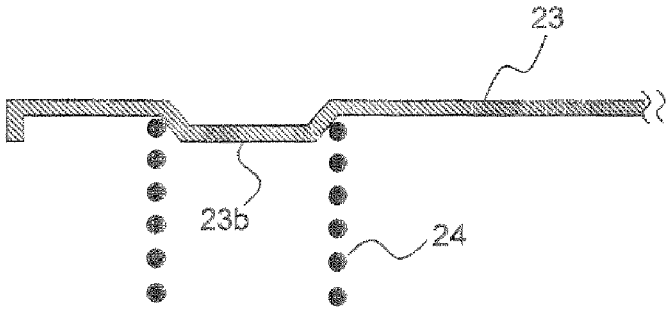
FIG. 4 is a partial cross-sectional view of the vicinity of a contact portion between a sheet stack plate 23 and a coil spring 24.
Figure 5:
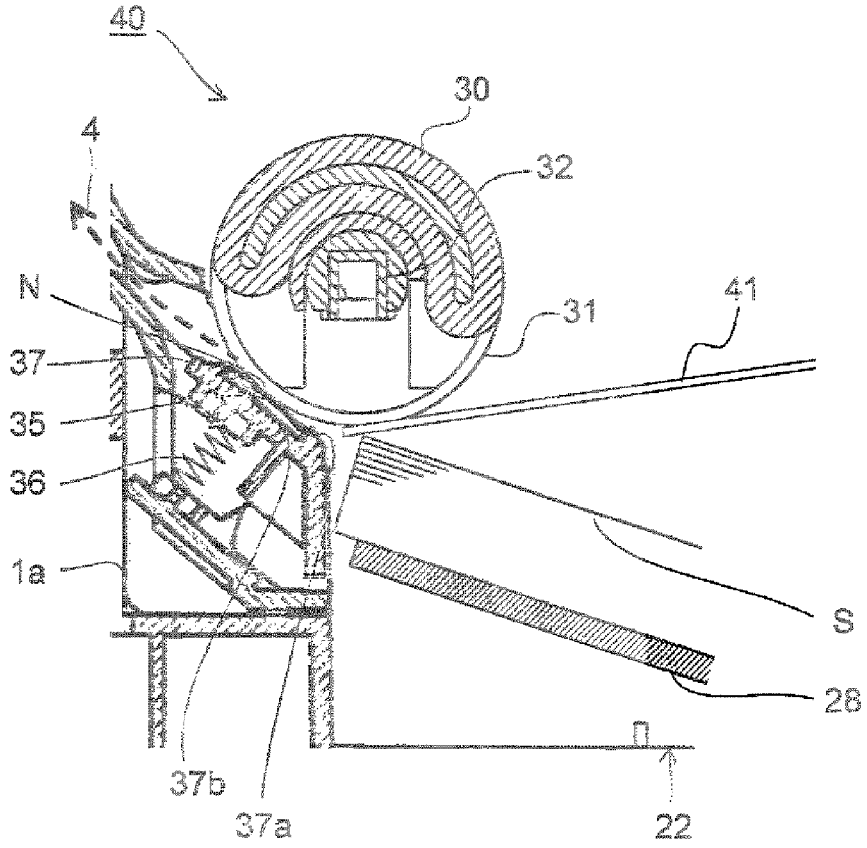
FIG. 5 is a partial cross-sectional view showing the vicinity of the sheet separation transport mechanism 40 of the paper feed device 20.

FIG. 2 is a perspective view when the paper feed device 20 is seen from above; FIG. 3 is a perspective view showing a state where the manual tray 41 is removed from the paper feed device 20 of FIG. 2; FIG. 4 is a partial cross-sectional view (cross-sectional view taken along line X-X' of FIG. 3 indicated by arrows) of the vicinity of a contact portion between the sheet stack plate 23 and a coil spring 24; FIG. 5 is a partial cross-sectional view showing the vicinity of the sheet separation transport mechanism 40 of the paper feed device 20. As shown in FIG. 3, the sheet stack plate 23, on which the sheets S are stacked, is provided in the paper feed cassette 22. The sheet stack plate 23 is supported rotatably in the paper feed cassette 22 at support points 23*a* on the upstream side in the sheet transport direction; an end portion on the downstream side in the sheet transport direction is moved up and down. The coil springs 24 attached to the bottom surface of the paper feed cassette 22 apply a force acting in an upward direction to the sheet stack plate 23.

As shown in FIG. 4, in two places in the vicinity of a rotating end (the left end of FIG. 3) of the sheet stack plate 23, boss portions 23*b* are formed that are convex toward the back surface of the sheet stack plate 23, and the coil spring 24 are arranged so as to fit to the boss portions 23*b*. On the inner side of the support points 23*a* of the sheet stack plate 23, a pair of first width alignment cursors 25 for regulating the position of the sheets in the width direction is provided.

Above the sheet stack plate 23, a shaft 32 that is rotated by a drive motor (not shown) is arranged. The shaft 32 is rotatably pivoted in the bearing (not shown) of a frame of the device body 1*a*. In an approximate center portion of the shaft 32 in the longitudinal direction, the paper feed roller 30 is fixed which is formed of an elastic material such as rubber, which is free from a portion of its outer circumferential surface and whose cross section is formed in the shape of a semicircle. The paper feed roller 30 feeds, to the sheet transport path 4, the sheets S stacked on the sheet stack plate 23 of the paper feed cassette 22 or the sheets S placed on the manual tray 41. When a plurality of sheets S are fed from the paper feed cassette 22, only the sheet S on the uppermost surface among a plurality of sheets S is separated in a nip portion N (main separation portion) between the paper feed roller 30 and the separation pad 35, and is fed to the sheet transport path 4.

Eccentric cams 33 whose maximum eccentricity radius is larger than the radius of the paper feed roller 30 are fixed to both end portions of the shaft 32. Furthermore, a driven gear (not shown) that is free from a portion of its circumferential surface is attached to one end portion of the shaft 32, and a drive gear (not shown) that is rotatably driven by the drive motor engages with the driven gear. Then, when the sheet S is fed, the drive force of the drive gear is transmitted by control means (not shown) at a predetermined timing to the driven gear, and thus the paper feed roller 30 and the eccentric cams 33 are rotated one revolution in a direction indicated by an arrow B by the rotation of the shaft 32. In positions of both side ends of the sheet stack plate 23 opposite the eccentric cams 33, cam followers 34 that can be brought into contact with the eccentric cams 33 are provided so as to protrude upward. In FIG. 2, the eccentric cams 33 are omitted.

Since, in the state of FIG. 2, the cam followers 34 provided on the sheet stack plate 23 are positioned on the upstream side (the right side of FIG. 2) of the shaft 32 in the paper feed direction, the cam followers 34 are prevented from being brought into contact with the shaft 32, and the sheet stack plate 23 is moved to the uppermost point by the acting force of the coil spring 24.

In this way, the stack of the sheets S on the sheet stack plate 23 are pressed by the paper feed roller 30, and the paper feed roller 30 is brought into contact with the sheets S in the uppermost portion and rotated, and thus a plurality of sheets S are fed in the transport direction (the left direction of FIG. 2). Then, the ends of the sheets S are divided by a front division portion 37*a*, and thereafter, on the downstream side in the transport direction of the sheet S, the back surface side of the sheets S is brought into contact with the separation pad 35 at a predetermined pressure, the friction with the separation pad 35 prevents the simultaneous feeding of a plurality of sheets S and only one sheet S is transported.

On the other hand, when the eccentric cams 33 are rotated in the direction indicated by the arrow B and are brought into the state shown in FIG. 3, the end portions of the eccentric cams 33 are rotated such that the end portions are placed substantially directly below the shaft 32. Here, the sheet stack plate 23 is pressed down to the lowermost point, and the distance between the shaft 32 and the sheet stack plate 23 is the largest.

On both sides of the paper feed roller 30 of the shaft 32, disc-shaped pulleys 31 are arranged whose diameter is slightly smaller than the outside diameter of the paper feed roller 30. The pulleys 31 are formed of a resin whose surface is smooth or the like, and regulate a position in the direction of the height of sheets S moved up to the paper feed position by the sheet stack plate 23 and also regulate a position in the direction in which the separation pad 35 is pressed.

On the side of the device body 1*a* opposite the paper feed roller 30 and the pulleys 31, a pad support member 37 is arranged, and the separation pad 35 is provided in the pad support member 37. The separation pad 35 is a rectangular plate-shaped member that has substantially the same width as the length between outside end portions of the pair of pulleys 31 in the axial direction, and is attached, with an adhesive or the like, to a pad retaining portion 37*b* of the pad support member 37. The separation pad 35 is formed of a material, such as foamed urethane or rubber, that has a high frictional force. The pad retaining portion 37*b* is arranged at a predetermined inclination angle with respect to the horizontal plane; the separation pad 35 attached to the pad retaining portion 37*b* is also arranged at the predetermined inclination angle with respect to the horizontal plane. Then, the rubber portion (semicircular portion) of the paper feed roller 30 is rotated in contact with the uppermost sheet S of the stack of the sheets S either on the sheet stack plate 23 or on the manual tray 41, and thus only the uppermost sheet S is separated with the separation pad 35 and is fed.

The pad support member 37 is retained by the device body 1*a* so that the pad support member 37 can be moved to the side of the paper feed roller 30; a force acting toward the paper feed roller 30 is applied to the pad support member 37 by a spring member 36 such as a coil spring. Specifically, when the rubber portion of the paper feed roller 30 is arranged opposite the separation pad 35, the pad support member 37 is retained such that the paper feed roller 30 is in contact with the separation pad 35. When the rubber portion of the paper feed roller 30 is arranged in such a position that the rubber portion is not opposite the separation pad 35 (the state of FIG. 3), the pad support member 37 is retained such that only the pulleys 31 are in contact with the separation pad 35. Then, when the rubber portion of the paper feed roller 30 is arranged opposite the separation pad 35, a predetermined nip pressure is applied to the nip portion N.

Hence, the paper feed roller 30 is rotated, and thus the rubber portion of the paper feed roller 30 is arranged opposite the separation pad 35, and the nip pressure is applied to the nip portion N, with the result that the sheet S is fed by the paper feed roller 30 to the sheet transport path 4. After the sheet S is fed, the rubber portion of the paper feed roller 30 is stopped in such a position that the rubber portion is not opposite the separation pad 35 (the state of FIG. 3), and the paper feed roller 30 is placed on standby for the feeding of the subsequent sheet S. As shown in FIG. 3, when the rubber portion of the paper feed roller 30 is moved out of the paper feed position by the rotation of the shaft 32, the sheet S is sandwiched between the separation pad 35 and the pulleys 31. In order to reduce the transport load of the sheet S at this time, the pulleys 31 are arranged rotatably with respect to the shaft 32.

The front division portion (guide portion) 37*a* is formed in the pad support member 37. The front division portion 37*a* is formed in the shape of an inclined surface on the upstream side of the nip portion N, and guides the ends of the sheets S fed from the paper feed cassette 22 to the nip portion N. Specifically, the sheets S stacked on the sheet stack plate 23 are fed to the front division portion 37*a* at a predetermined inclination angle with respect to the horizontal plane; the angle of the inclined surface of the front division portion 37*a* with respect to the horizontal plane is set at an angle that is greater than the maximum inclination angle of the sheets S that is changed according to the number of stacked sheets S, that is, an angle formed when the sheet stack plate 23 make contact with the paper feed roller 30. The angle of the inclined surface of the front division portion 37*a* with respect to the horizontal plane is set at an angle greater than the inclination angle of the separation pad 35.

In this way, the ends of the sheets S fed from the paper feed cassette 22 are brought into contact with the front division portion 37*a*, and smoothly enter the nip portion N along the front division portion 37*a*. When a plurality of sheets S are simultaneously fed from the paper feed cassette 22, the ends of the sheets S are divided along the inclined surface of the front division portion 37*a*, and the sheets S arranged on the upper side among the sheets S are moved faster to the nip portion N. Thus, it is possible to reduce the simultaneous entry of the sheets S into the nip portion N.

The manual tray 41 is provided above the paper feed cassette 22. On the upper surface of the manual tray 41, a pair of second width alignment cursors 43 for locating the position of the sheets S in the width direction is provided. The sheets S placed on the manual tray 41 are supported by the lower portion of the paper feed roller 30 when the sheet stack plate 23 is moved upward, and are fed along the upper surface of the manual tray 41 by the rotation of the paper feed roller 30. As shown in FIG. 5, the end of the manual tray 41 is extended up to the position of the front division portion 37*a* on the upstream side in the sheet transport direction, and the end portions of the sheets S are brought into contact with the front division portion 37*a*, and are then guided to the vicinity of the end portion (the right end portion of FIG. 5) of the separation pad 35 on the upstream side in the sheet transport direction along the shape of the inclined surface of the front division portion 37*a*.

Figure 6:
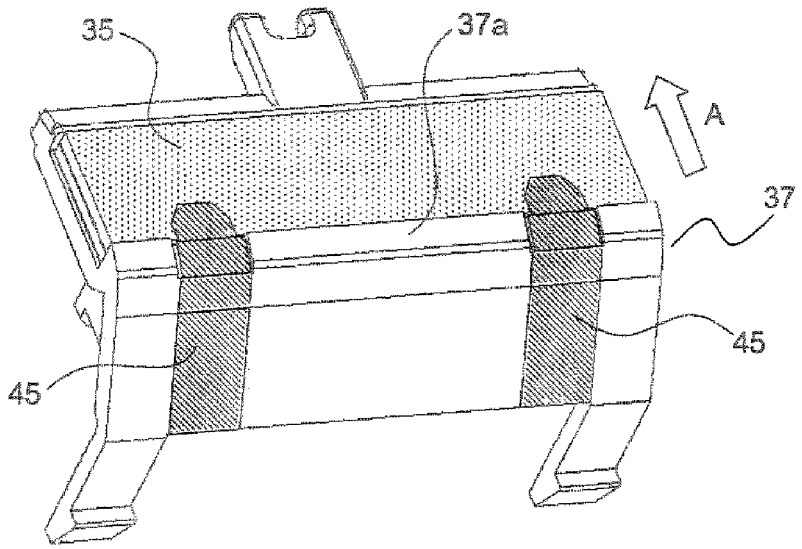
FIG. 6 is a perspective view of a separation pad 35 and a pad support member 37.
Figure 7:
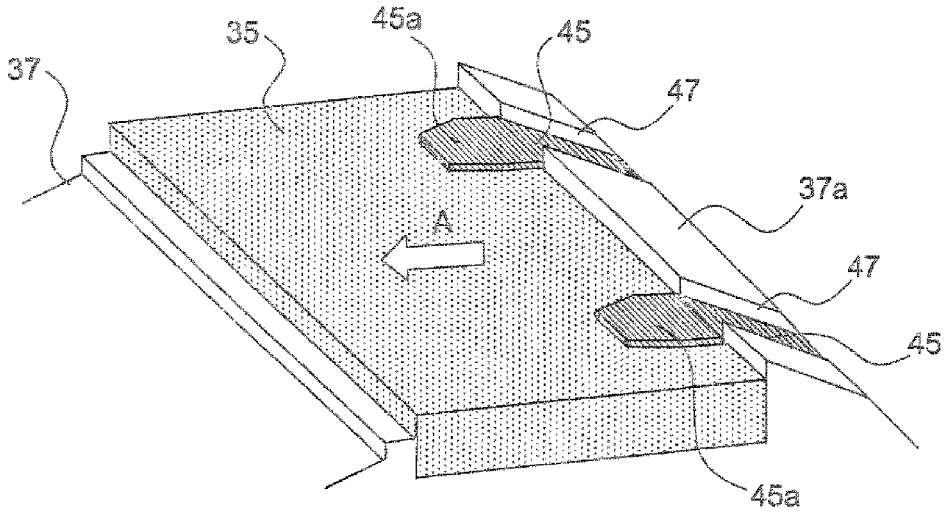
FIG. 7 is a partial enlarged view of the vicinity of the separation pad 35 of FIG. 6.

FIG. 6 is a perspective view of the separation pad 35 and the pad support member 37; FIG. 7 is a partial enlarged view of the vicinity of the separation pad 35 of FIG. 6. An arrow A in the figures represents the sheet transport direction; FIG. 7 shows a state where the pad support member 37 of FIG. 6 is rotated about 90 degrees.

The pad support member 37 is formed of a polycarbonate containing glass fibers; on the sheet entry side of the pad support member 37 (on the upstream side in the sheet transport direction, the lower side of FIG. 6), two sheet members 45 are adhered along the sheet transport direction with a predetermined space therebetween in the sheet width direction (the left/right direction of FIG. 6). The sheet member 45 is formed of a material that has a frictional coefficient (excellent smoothness) lower than the separation pad 35 and the pad support member 37. Here, as the sheet member 45, a sheet is used that has a thickness of 0.1 mm and that is formed of a polyacetal.

The sheet members 45 are adhered such that they are passed through groove-shaped concave portions 47 formed in the front division portion 37*a* from the sheet entry side of the pad support member 37 and are extended to the vicinity of the end portion of the separation pad 35 on the upstream side in the sheet transport direction. The concave portions 47 are formed such that the depth thereof is greater than the thickness of the sheet members 45, and thus the sheet members 45 are prevented from protruding from the surface (transport surface) of the front division portion 37*a*.

Figure 8:
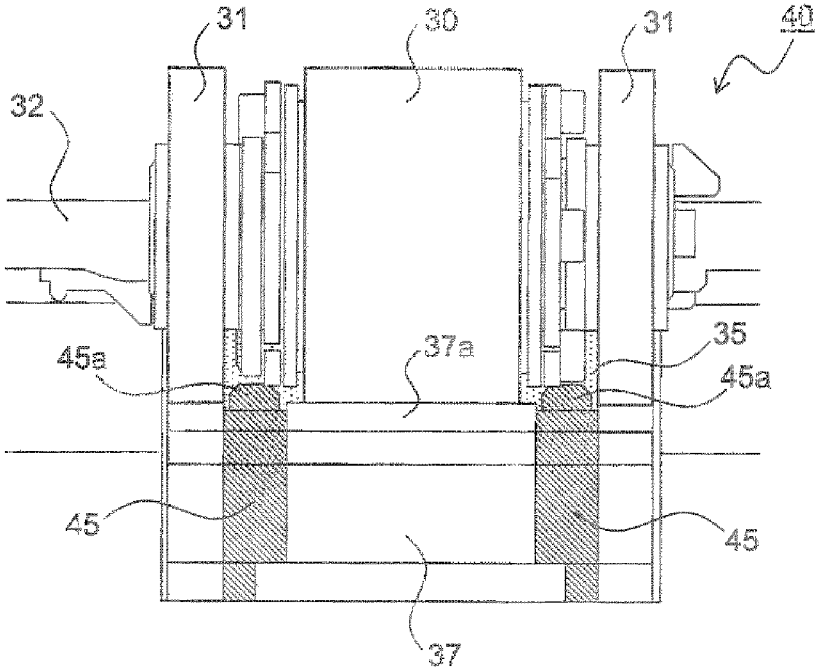
FIG. 8 is a front view when the sheet separation transport mechanism 40 is seen from the upstream side in a sheet transport direction.

FIG. 8 is a front view when the sheet separation transport mechanism 40 is seen from the upstream side in the sheet transport direction. The sheet members 45 are fixed between the paper feed roller 30 and the pulleys 31; the end portions 45*a* of the sheet members 45 are positioned close to the upstream side of the nip portion N (see FIG. 5) in the sheet transport direction.

In the configuration described above, the sheets S fed from the sheet stack plate 23 of the paper feed cassette 22 are guided to the front division portion 37*a*. Here, the sheet members 45 are adhered to the concave portions 47 of the front division portion 37*a*, and thus the sheets S are not in contact with the sheet members 45. Hence, the division function (frictional coefficient) of the front division portion 37*a* is enhanced as compared with the sheet members 45, and thus it is possible to reliably perform the division along the inclination of the front division portion 37*a* when a plurality of sheets S are guided to the front division portion 37*a*.

The ends of the sheets S which have passed through the front division portion 37*a* are brought into contact with the end portions 45*a* of the sheet members 45. Since the sheet member 45 has a frictional coefficient lower than the separation pad 35, the transport load is slightly lowered as compared with a conventional configuration where the sheet members 45 are not adhered. However, since the sheets S are brought into contact with the surface of the separation pad 35 other than the sheet members 45, it is possible to acquire a certain degree of transport load. Since the sheet members 45 are adhered to only the upstream side of the nip portion N, as in the conventional manner, the transport load produced by friction between the paper feed roller 30 and the separation pad 35 is applied to the sheets S transported to the nip portion N. Thus, it is possible to acquire a function of separating the sheets S that is required in practical use.

On the other hand, the ends of the sheets S fed from the manual tray 41 are first brought into contact with the front division portion 37*a*, are guided to the side end portion of the separation pad 35 on the upstream side along the shape of the inclined surface of the front division portion 37*a* and are brought into contact with the end portions 45*a* of the sheet members 45. Since, in the surface of the manual tray 41 on which the sheets S are placed, an angle with respect to the inclined surface of the front division portion 37*a* is greater than that of the sheet stack plate 23, the angle formed between the sheets S fed from the manual tray 41 and the separation pad 35 is increased. Consequently, especially when a sheet S, such as heavy paper, that has a high elasticity is transported, the transport load is increased, and thus the sheet S may be prevented from being fed to the nip portion N.

Hence, as in the present embodiment, the sheet members 45 are adhered to the separation pad 35, and thus the ends of the sheets S fed from the manual tray 41 are brought into contact with the end portions 45*a* of the sheet members 45 having a low frictional coefficient. Thus, it is possible to reduce the transport load caused by the contact between the sheets S and the separation pad 35, with the result that it is possible to effectively reduce the failure in the feeding to the nip portion N even when a sheet, such as heavy paper, that has a high elasticity is transported. The sheet members 45 are extended close to the upstream side of the nip portion N in the sheet transport direction, and thus it is possible to reliably guide the ends of the sheets S to the nip portion N.

The separation pad 35 is formed of an elastic material, and thus a force acting in the sheet transport direction is applied to the separation pad 35 by friction caused by the rotation of the paper feed roller 30 or by friction with the back surface of the sheets S transported. Consequently, a long-term use causes the separation pad 35 to be deformed or moved to the downstream side in the sheet transport direction, and this may result in the production of a gap between the front division portion 37*a* and the separation pad 35. Then, depending on the type and the state of the sheets transported, the ends of the sheets are caught in the gap, and thus a transport failure is caused.

However, since, in the present embodiment, the sheet members 45 are adhered from the sheet entry side of the pad support member 37 to the separation pad 35, the separation pad 35 is prevented from being deformed or moved to the downstream side in the sheet transport direction. Even if the deformation or the movement of the separation pad 35 causes a gap between the front division portion 37*a* and the separation pad 35, the sheet members 45 are adhered so as to cover the gap, and thus it is possible to prevent the sheets from being caught therein.

The sheet members 45 are adhered between the paper feed roller 30 and the pulleys 31, and thus it is possible to extend the sheet members 45 close to the upstream side of the nip portion N and thereby sufficiently reduce the transport load, and to reliably feed heavy paper or the like transported from the manual tray 41 to the nip portion N. Furthermore, even when, in the transport direction, variations are produced in the position where the sheet members 45 are adhered, there is no possibility that the sheet members 45 are wound into the nip portion N and thus the sheet members 45 are separated.

The present disclosure is not limited to the embodiment described above; many variations are possible without departing from the spirit of the present disclosure. For example, although, in the above embodiment, a force acting upward is applied by the coil spring 24 to the sheet stack plate 23, the eccentric cams 33 rotated together with the shaft 32 are brought into contact with the cam followers 34 provided on the sheet stack plate 23 and thus the sheet stack plate 23 is moved up and down, the present disclosure is not limited to this configuration. The sheet stack plate 23 of the paper feed cassette 22 may be moved up and down through a lift plate by an up/down movement motor, and the sheets S stacked on the sheet stack plate 23 may be fed by a pickup roller to the side of the paper feed roller 30.

Although, in the above embodiment, as the separation member pressed onto the paper feed roller 30, the flat plate-shaped separation pad 35 is used, the present disclosure is not limited to this configuration. For example, a roller-shaped separation member that is not rotated may be pressed onto the paper feed roller 30. Although the shape of the inclined surface of the front division portion 37*a* is flat, the shape of an inclined surface that is slightly concave or convex may be adopted instead. As the sheet feed member that feeds the sheet, instead of the paper feed roller 30, an endless paper feed belt may be used that is placed over a plurality of rollers in a tensioned state and that is rotated.

Although, in the above embodiment, the paper feed device 20 that includes the paper feed cassette 22 and the manual tray 41 which are used as supply sources of the sheets S where images are to be formed has been described as an example, the paper feed device of the present disclosure can be naturally applied to a paper feed device that includes either the paper feed cassette 22 or the manual tray 41, an original document transport device that transports a plurality of original sheets one after another, an inserter device that is arranged as a supply source of interleaving paper between an image forming apparatus and a sheet post-processing device and the like.

The present disclosure can be utilized as a sheet separation transport mechanism that is used in a sheet transport device such as a paper feed cassette or an original document transport device and that separates and transports a stack of sheets one by one. By the utilization of the present disclosure, it is possible to provide a sheet separation transport mechanism and a sheet transport device that enhance the function of separating sheets with a simple configuration to reduce the simultaneous feeding of a plurality of sheets and the failure in the feeding of heavy paper or the like having a high elasticity, and an image forming apparatus that reduces the simultaneous feeding of a plurality of sheets or original documents from a paper feed device or an original document transport device or the failure in the feeding thereof and that thereby can perform a stable image formation operation.

What is claimed is:

1. A sheet separation transport mechanism comprising:

a sheet feed member that feeds a sheet in a transport direction;

a separation member that is pressed onto the sheet feed member;

a support member that includes: a carriage return and indent a separation member retaining portion which retains the separation member; and a line return and indent a guide portion which is formed in a shape of an inclined surface protruding beyond a surface of the separation member on an upstream side of the separation member retaining portion in the sheet transport direction and which guides lead edges of a plurality of sheets to a downstream side along the inclined surface;

a sheet member that is adhered from the guide portion so as to overlap the separation member and that has a frictional coefficient lower than the separation member; and a concave portion that is formed in a shape of a groove which extends long-ways in the transport direction in a position of the guide portion where the sheet member is adhered such that a depth of the concave portion is greater than a thickness of the sheet member, wherein only an uppermost one of the stacked sheets being separated and transported in a nip portion between the sheet feed member and the separation member, a carriage return and indent wherein the sheet feed member is above the separation member.

2. The sheet separation transport mechanism of claim 1, wherein the sheet member is extended close to an upstream side of the nip portion in the sheet transport direction.

3. The sheet separation transport mechanism of claim 1, wherein the sheet member regulates a movement of the separation member in the transport direction.

4. The sheet separation transport mechanism of claim 1, wherein the sheet member has a frictional coefficient lower than the guide portion.

5. The sheet separation transport mechanism of claim 1, wherein the sheet feed member is a paper feed roller which is free from a portion of an outer circumferential surface and whose cross section is formed in a shape of a semicircle, on both sides of the paper feed roller in an axial direction, disc-shaped pulleys whose diameter is smaller than an outside diameter of the paper feed roller are arranged a predetermined space apart from the paper feed roller, and the sheet members are adhered to two places on the support member opposite gaps between the paper feed roller and the pulleys.

6. The sheet separation transport mechanism of claim 1, wherein the separation member is a flat plate-shaped separation pad that is arranged to be inclined in the same direction as the inclined surface of the guide portion, and an angle of the inclined surface of the guide portion with respect to a horizontal plane is set greater than an inclination angle of the separation pad.

7. A sheet transport device comprising:

the sheet separation transport mechanism of claim 1.

8. The sheet transport device of claim 7 comprising:

a paper feed cassette that is provided with a sheet stack plate on which the sheets are stacked and which can be moved upward;

a manual tray that is arranged above the paper feed cassette; and the sheet separation transport mechanism that is arranged on a downstream side of the paper feed cassette and the manual tray in the sheet transport direction, wherein the sheet separation transport mechanism allows lead edges of the sheets stacked on the sheet stack plate or the manual tray to make contact with the guide portion and thereafter make contact with the sheet member.

9. The sheet transport device of claim 8, wherein an angle of an inclined surface of the guide portion with respect to a horizontal plane is set greater than a maximum inclination angle of the sheets stacked on the sheet stack plate.

10. An image forming apparatus comprising:

the sheet transport device of claim 7.

* * * * *